US011452344B2

(12) United States Patent
Lennings et al.

(10) Patent No.: US 11,452,344 B2
(45) Date of Patent: Sep. 27, 2022

(54) CHEST BUCKLE FOR A HARNESS

(71) Applicant: Globe (Jiangsu) Co., Ltd., Changzhou (CN)

(72) Inventors: Eric Lennings, Huskvarna (SE); Emma Ekberg, Goeteborg (SE)

(73) Assignee: Globe (Jiangsu) Co., Ltd., Jiangsu (CN)

( * ) Notice: Subject to any disclaimer, the term of this patent is extended or adjusted under 35 U.S.C. 154(b) by 274 days.

(21) Appl. No.: 16/651,239

(22) PCT Filed: Sep. 27, 2017

(86) PCT No.: PCT/CN2017/103739
§ 371 (c)(1),
(2) Date: Mar. 26, 2020

(87) PCT Pub. No.: WO2019/061092
PCT Pub. Date: Apr. 4, 2019

(65) Prior Publication Data

US 2020/0323312 A1 Oct. 15, 2020

(51) Int. Cl.

| | |
|---|---|
| ***A44B 11/25*** | (2006.01) |
| ***A45F 3/14*** | (2006.01) |
| *A45F 3/00* | (2006.01) |

(52) U.S. Cl.
CPC ..... *A44B 11/2592* (2013.01); *A45F 3/14* (2013.01); *A45F 2003/003* (2013.01); *A45F 2003/142* (2013.01); *A45F 2200/0575* (2013.01)

(58) Field of Classification Search
CPC .. A44B 11/2592; A45F 3/14; A45F 2003/142; A45F 2200/0575; A45F 2003/146; A45F 2003/003; A45F 3/04; A45F 2003/001
See application file for complete search history.

(56) References Cited

U.S. PATENT DOCUMENTS 4,776,504 A 10/1988 Panth
6,038,747 A * 3/2000 Hamilton ..... A45F 3/047 24/632
6,662,413 B2 * 12/2003 Glover ..... B60R 22/105 24/615

(Continued)

FOREIGN PATENT DOCUMENTS

WO 2008147257 A1 12/2008

OTHER PUBLICATIONS

Search Report and Written Opinion in related International Patent Application No. PCT/CN2017/103739 dated Jul. 17, 2018; 10 pages.

*Primary Examiner* — Robert Sandy
*Assistant Examiner* — Louis A Mercado
(74) *Attorney, Agent, or Firm* — Rooney IP, LLC

(57) ABSTRACT

A chest buckle for a harness for carrying a handheld motor-driven work tool, the chest buckle including first and second parts, wherein the first and second part, each includes at least two mechanisms attaching straps of the harness thereto. The first part includes a recess defining a cavity arranged to accommodate the second part therein. The second part includes a resilient locking member arranged to protrude through a hole in the first part when the second part is accommodated in the cavity to lock the first and second parts together.

21 Claims, 3 Drawing Sheets

(56) References Cited

U.S. PATENT DOCUMENTS

| | | | | |
|---|---|---|---|---|
| 8,974,005 | B2 * | 3/2015 | Mason | A44B 11/263 297/484 |
| D736,115 | S * | 8/2015 | Welch | D11/216 |
| 10,716,388 | B2 * | 7/2020 | Pellenc | A45F 3/14 |
| 2011/0193396 | A1 * | 8/2011 | Friedman | B60R 22/48 297/484 |
| 2014/0103697 | A1 | 4/2014 | Mason et al. | |
| 2015/0208792 | A1 | 7/2015 | Bergkvist | |

* cited by examiner

CHEST BUCKLE FOR A HARNESS

TECHNICAL FIELD

The present invention relates generally to a chest buckle for a harness for carrying a hand-held motor-driven tool such as a clearing saw, the chest buckle having a quick-release function for easy opening and removal.

BACKGROUND ART

There is a wide variety of clearing saws and brush cutters in use in modern forestry and garden maintenance. This type of equipment is intended to be handled by one person alone, and since the equipment could be quite heavy and its vibrations and the possible counter forces, caused by the branches being cut, have to be considered, one readily realizes the need for some sort of harness to aid the user in carrying the weight of the equipment.

Known harnesses usually include shoulder straps, a side strap, a waist band, and a load carrying support strap, which are all connected, with at least one end to a back portion. Except for the waist band, the straps are connected with their respective second ends to a chest plate. The chest plate consists of two or more parts, which may be separated to provide quick and easy entrance into and exit from the harness, without having to adjust all the different straps.

WO 2008/147257 discloses a harness for carrying a handheld motor-driven tool, such as a clearing saw. The harness comprises a back portion, two shoulder straps a support strap for the tool, a side strap for distributing the weight of the tool, and a chest plate. A fastening device for the side strap is detachable from the chest plate and is attachable on the support strap below the chest plate. The chest plate employs a snap fastening between two side parts.

Drawbacks associated with this chest plate are that forces acting on the chest plate when the user carries heavy tools with the harness may act to undo the fastening while at the same time the fastening can be difficult to undo using only hand.

SUMMARY OF INVENTION

An object of the present invention is to provide an improved chest buckle for a harness which facilitates quick-release whilst withstanding and distributing forces caused by heavy loads. This object is now achieved by a chest buckle according to a first aspect of the present invention, the chest buckle comprising first and second parts, wherein the first and second part each comprises at least two means for attaching straps of the harness thereto, wherein the first part comprises a cavity arranged to accommodate the second part therein, wherein the second part comprises a resilient locking member arranged to protrude through a hole in the first part when the second part is accommodated in the cavity to lock the first and second parts together.

By providing at least two means for attaching straps of the harness on each of the first and second parts of the chest buckle, the forces caused by the weight of the power tool are distributed between the straps of the harness, increasing the comfort of the operator wearing the harness. At the same time, the chest buckle may be released quickly with minimum effort by depressing the resilient locking member.

In a preferred embodiment, the cavity comprises an opening arranged in a side portion of the first part and adapted to receive the second part in a lateral translational or linear insertion movement. The lateral insertion movement facilitates assembling the chest buckle in one easy motion.

In an advantageous embodiment, the hole is arranged in a longitudinal edge of the first part, which extends parallel to the insertion direction, and the resilient locking member is arranged to protrude through the hole in a direction substantially perpendicular to the insertion direction. By arranging the hole such that the protrusion direction of the resilient locking member is substantially perpendicular to the insertion movement ensures that the chest buckle remains locked and is released by strains caused by loads on the straps of the harness.

In an alternative embodiment, the resilient locking member comprises a C-shaped web portion attached at one end to the second part and a transversal portion arranged at the opposite end of the web portion and substantially parallel to a longitudinal edge of the second part, wherein the web portion is adapted to act as a spring to bias the transversal portion in a direction substantially perpendicular to the longitudinal edge to protrude beyond the longitudinal edge. Preferably, the web portion comprises two parallel shanks. By providing a web portion of the resilient locking member in the shape of the letter C, an optimal spring function is achieved in the plane of the second part which also enables uniform movement of the transversal portion, i.e. the transversal portion remains substantially parallel to the longitudinal edge of the second part throughout the movement.

In a further preferred embodiment, the transversal portion comprises a bevelled or chamfered surface on a leading and/or trailing edge seen in an insertion direction of the second part with respect to the first part. The bevelled surfaces facilitate insertion of the second part into the first part when assembling the chest buckle.

In an advantageous embodiment, the first part and the second part have a substantially hexagonal shape. Preferably, the first part comprises two substantially hexagonal plates joined together along four edges. Preferably, the at least two attachment means for the straps of the harness comprise slots arranged on two adjacent edges of the first and second part, respectively. More preferably, the edges comprising slots on the first and second part are arranged diametrically opposite of each other when the first and second parts are assembled together in a locked position. The placement of the slots on adjacent, substantially diametrically opposed edges of the provides an optimal orientation of the straps, e.g. shoulder straps, side strap, hip strap, connecting straps etc., and distribution of the forces caused by the weight of the power tool.

In an alternative embodiment, the second part comprises a notch arranged on a distal end seen in an insertion direction of the second part with respect to the first part, wherein the first part comprises a corresponding protrusion arranged in the recess and adapted to fit into the notch when the first and second parts are assembled together in a locked position. The notch and the protrusion of the assembled chest buckle act together as a force distribution element to further relieve strains on the chest buckle and prevent rotation of the first and second parts with respect to each other to ensure it remains locked and intact.

In a second aspect of the present invention, there is provided a harness comprising a chest buckle according to the first aspect.

BRIEF DESCRIPTION OF DRAWINGS

The invention is now described, by way of example, with reference to the accompanying drawings, in which.

DESCRIPTION OF EMBODIMENTS

Figure 1A:
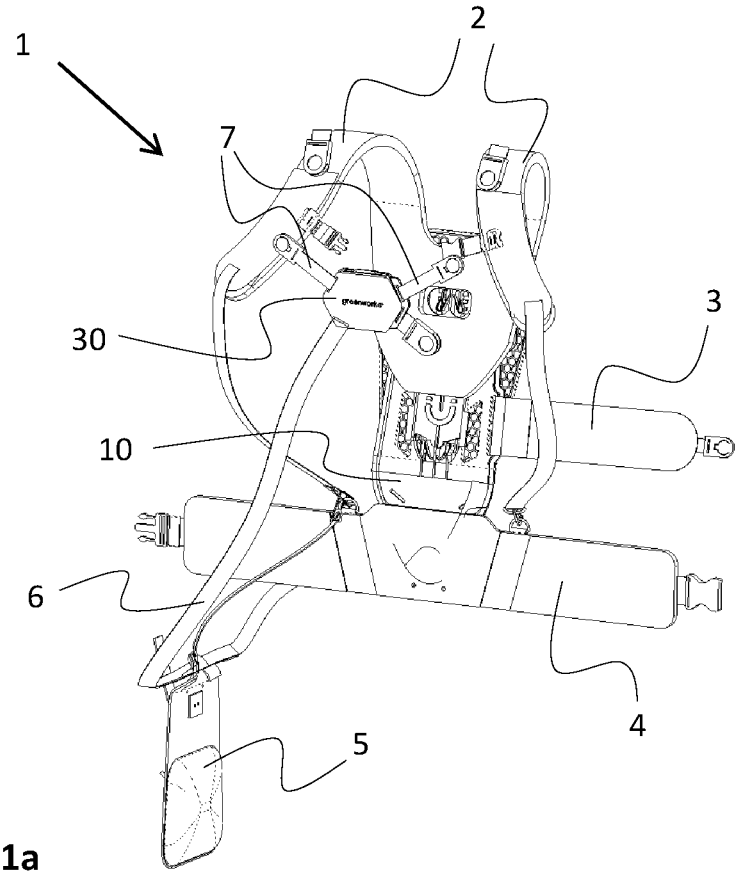
FIGS. 1*a* and 1*b* show front and rear perspective views, respectively, of an exemplary harness comprising a chest buckle according to the present invention.

In the following, a detailed description of a chest buckle according to the invention is presented. In the drawing figures, like reference numerals designate identical or corresponding elements throughout the several figures. It will be appreciated that these figures are for illustration only and are not in any way to be seen as restricting the scope of the invention.

Figure 1B:
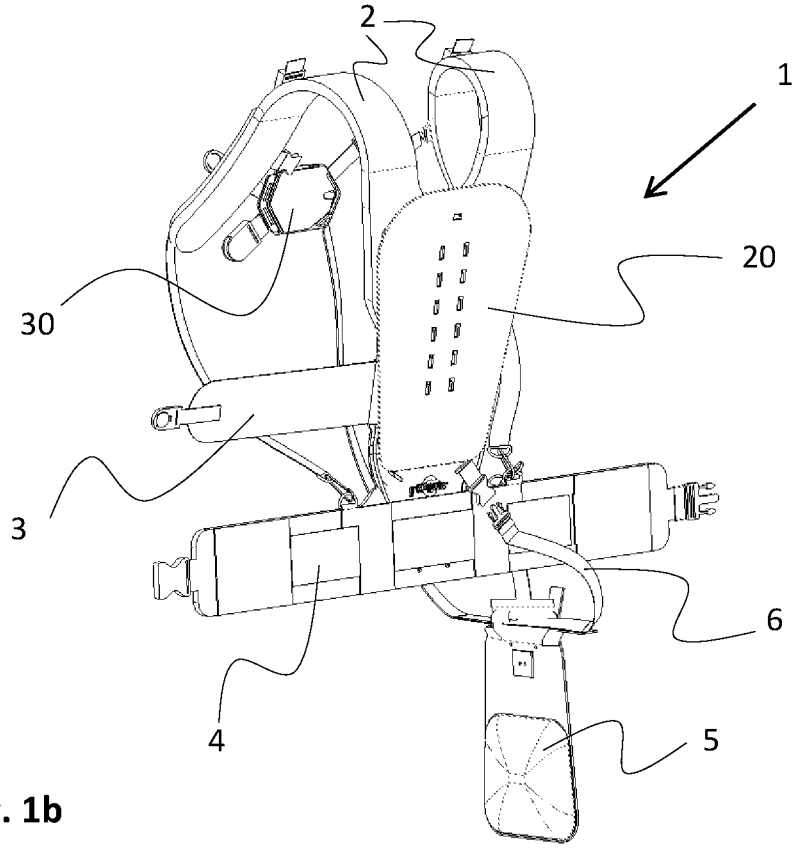

FIGS. 1*a* and 1*b* show in perspective views the front and rear of an exemplary harness 1 for carrying a handheld, motor-driven power tool (not shown) of the kind described in the introductory portion, which may be used together with a chest buckle according to the present invention. The harness 1 comprises a pair of shoulder straps 2 to be worn on the shoulders by the operator. The shoulder straps 2 are connected to a back plate 10 by means of a carrier assembly (not shown). Attached on the rear face of the back plate 10, there is shown an interface plate 20 which together with the back plate 10 form a chest buckle according to the present invention, as will explained more in detail below. Further, on one side of the back plate 10 there is attached a side strap 3 for providing additional stability and support when carrying the power tool. In a bottom portion of the back plate 10, a hip belt 4 is attached to be worn around the hips by the operator. On the opposite side of the side strap 3, there is provided a hip plate 5 comprising means (not shown) for attaching the power tool. The hip plate 5 is connected to the harness 1 by means of strap 6, which attaches to the back plate 10 on the rear face of the harness 1, as shown in FIG. 1*b*. On a front side of the harness 1, there is provided a chest buckle 30 arranged for attachment of the strap 6 for the hip plate 5, the side strap 3 and connecting straps 7 to the shoulder straps 2 to keep the harness 1 in place on the body of the operator during use and allow for distribution of forces caused by the weight of the power tool.

The harness 1 is designed to provide a comfortable fit for the operator, distribute the forces caused by the weight of the power tool and allow freedom of movement for the operator during operation of the power tool.

As mentioned above, one of the objects of the present invention is to provide an improved chest buckle for a harness which facilitates quick-release whilst withstanding and distributing forces caused by heavy loads. To this end, a chest buckle 30 is provided for the connection between the side strap 3, the strap 6 for the hip plate 5 and connecting straps 7 to the shoulder straps 2.

Figure 2A:
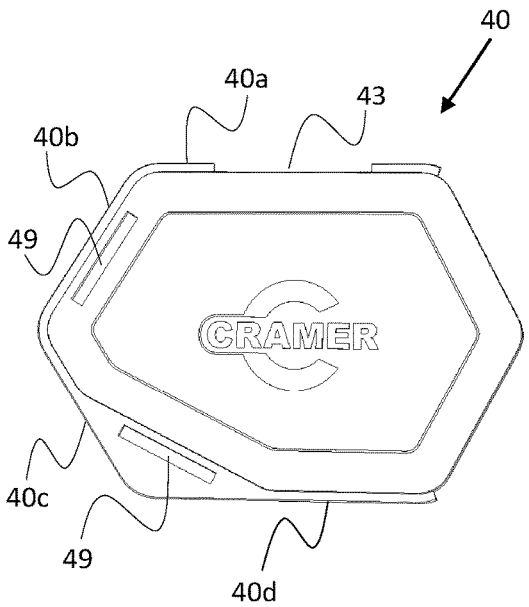
FIGS. 2*a* and 2*b* show face views of first and second parts, respectively, of the chest buckle according to the present invention.
Figure 2B:
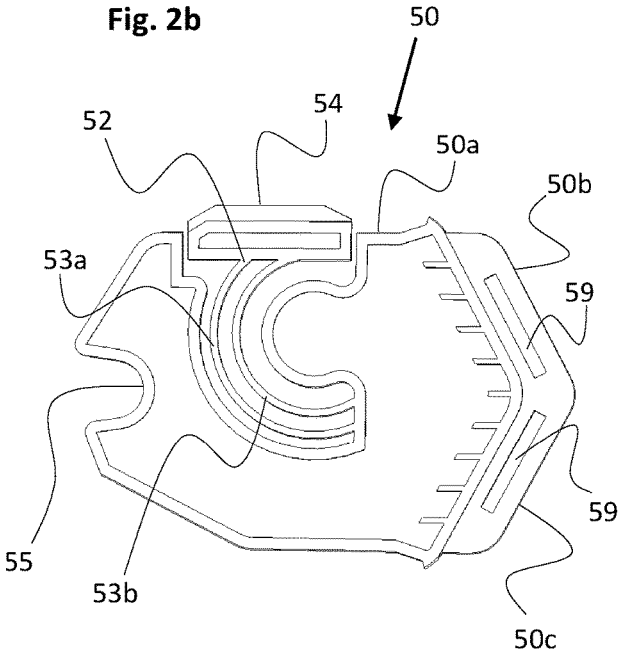

In FIGS. 2*a* and 2*b*; 3*a* and 3*b*, the first and second parts 40, 50 of the chest buckle 30 are illustrated in face and perspective views. The first part 40 comprises a recess 41 defining a cavity which is arranged to receive and accommodate the second part 50 therein when the chest buckle 30 is assembled together. To this end, the first part 40 comprises two plates 42*a*, 42*b* joined together at side edges 40*a*, 40*b*, 40*c* and 40*d* to form the recess 41 there between and leaving an opening 44 for insertion of the second part 50. In one embodiment, the first part 40 has a somewhat truncated, substantially hexagonal shape, wherein longitudinal edges 40*a* and 40*d* are located diametrically opposite one another and parallel to the insertion direction of the second part 50 into the recess 41 and are also longer than remaining edges 40*b* and 40*c*. Attachment means 49 for attaching straps of the harness 1 to the first part 40 are arranged on or adjacent edges 40*b* and 40*c*, e.g. in the form of through-going slots 49. In the upper longitudinal edge 40*a*, there is provided a through-going hole 43 arranged to provide a locking engagement with the second part 50.

Figure 3A:
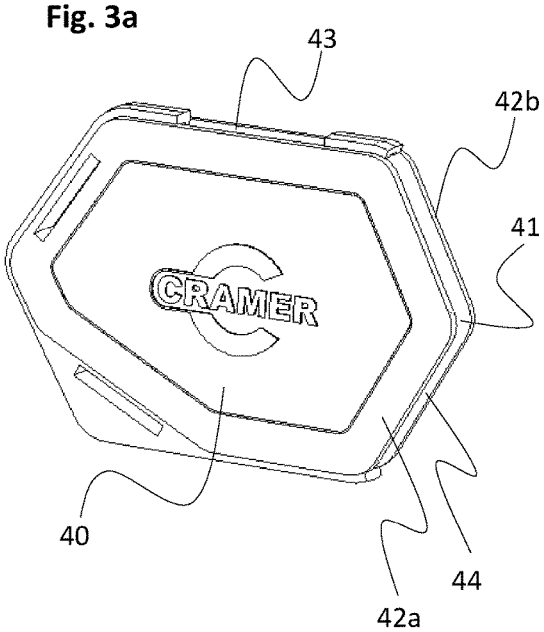
FIGS. 3*a* and 3*b* show perspective views of the first and second parts, respectively, of the chest buckle according to the present invention.
Figure 3B:
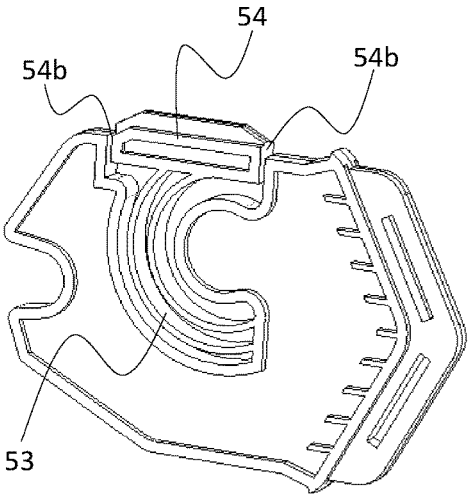

Turning now to FIGS. 3*a* and 3*b*, the second part 50 of the chest buckle 30 is formed by a single, plate-shaped member which is arranged to fit into the recess 41 of the first part. The second part 50 comprises a resilient locking member 52, which is adapted to protrude through the hole 43 when the two parts of the chest buckle 30 are assembled together. To this end, the resilient locking member 52 comprises a C-shaped web portion 53 and a transversal portion 54. The web portion 53 lies within the plane defined by the second part 50 and acts like a spring to bias the transversal portion 54 in a direction substantially perpendicular to the insertion direction of the second part 50 into the recess 41 of the first part 40. Thus, the transversal portion 54 is normally oriented parallel to and protrudes beyond a longitudinal edge 50*a* of the second part 50. Further, the transversal portion 54 may comprise a bevelled or chamfered surface on a leading and/or trailing edge 54*a*, 54*b*, seen in an insertion direction of the second part 50 with respect to the first part 40. Similar to the first part, attachment means 59 for attaching straps of the harness 1 to the second part 50 are arranged on or adjacent edges 50*b* and 50*c*, e.g. in the form of through-going slots 59.

In one embodiment, the web portion 53 comprises two substantially parallel shanks 53*a*, 53*b* which are attached to the second part 50 at one end thereof, and to the transversal portion 54 at the opposite end. The resilient locking member 52 may be integrally formed with the second part 50, e.g. through moulding or cutting, or may be formed separately and subsequently attached to the second part 50.

Figure 4A:
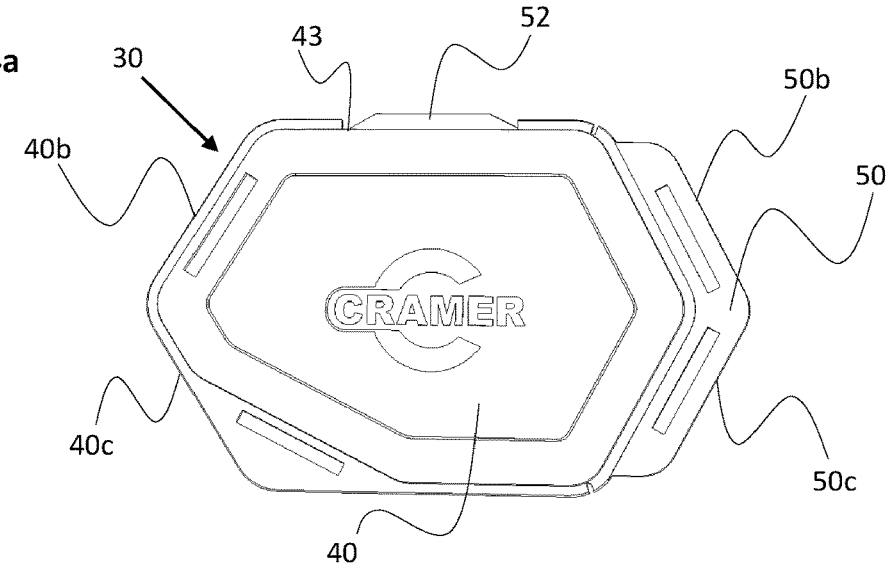
FIGS. 4*a*, 4*b* and 4*c* show face, perspective and cross-sectional views, respectively, of the first and second parts of the chest buckle according to the present invention assembled together.
Figure 4B:
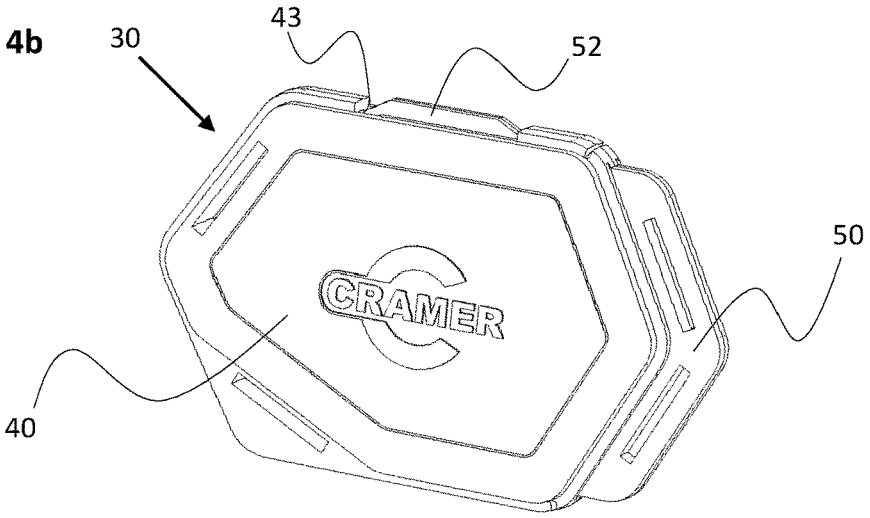
Figure 4C:
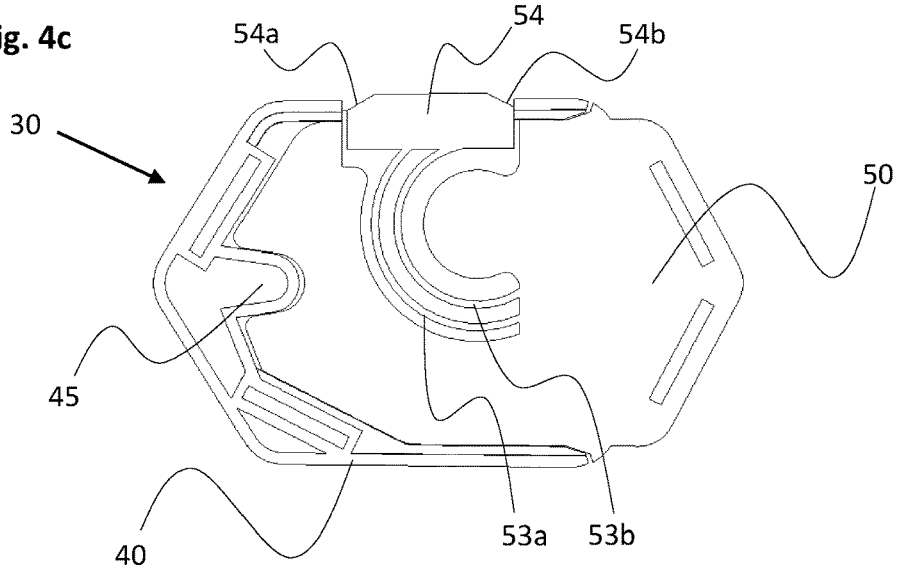

In FIGS. 4*a*, 4*b* and 4*c*, the chest buckle 30 is shown with the first and second parts 40, 50 assembled together in locking engagement. As may be seen, the edges 40*b*, 40*c*; 50*b*, 50*c* comprising the slots 49; 59 for attachment of the straps of the harness 1 are located diametrically opposite one another owing to the substantially hexagonal shape of the chest buckle 30, which distributes the forces from the straps (and ultimately the tool being carried in the harness 1) across the chest buckle 30. When assembled in a locked position, only the resilient locking member 52 and the edges 50*b*, 50*c*, comprising the slots 59 for attachment of the straps of the harness 1, of the second part 50 may be seen.

In use, the operator puts on the harness 1 and brings the first and second parts 40, 50, with two or more of the corresponding straps attached thereto, together in an insertion direction coinciding with the longitudinal edges 40*a*, 40*d*; 50*a*. As the second part 50 enters the recess 41, the longitudinal edge 40*a* comes into contact with the transversal portion 54 of the resilient locking member 52. The longitudinal edge 40*a* acts on the resilient locking member 52 to depress the transversal portion 54 and the web portion 53 inwardly, perpendicular to the longitudinal edge 50*a*. As soon as the trailing edge 54*b* of the transversal portion 54 has moved past the rim of the hole 43 in the first part 40, the web portion 53 biases the transversal portion 54 outwardly to protrude through the hole 43 and thereby lock the second part 50 in the second part 40. The bevelled or chamfered surfaces of the leading and/or trailing edges 54*a*, 54*b* of the transversal portion 54 assist smooth operation of the sliding motion in depressing the resilient locking member 52.

To release the chest buckle 30, the operator simply depresses the resilient locking member 52 and simultaneously pulls the second part 50 out of the recess 41 in the first part 40 in one movement.

In order to further optimise force distribution across the chest buckle 30, the second part 50 comprises a notch 55 arranged on a distal end, seen in the insertion direction of the second part 50, opposite the edges 50*b*, 50*c*. Correspondingly, the recess 41 comprises a protrusion 45 in a proximal region adjacent the edges 40*b*, 40*c* which is arranged to fit into the notch 55 of the second part 50 when the chest buckle 30 is assembled. The protrusion 45 and the notch 55 cooperate to prevent rotational movement of the second part 50 with respect to the first part 40.

The invention claimed is:

1. A chest buckle for a harness for carrying a handheld motor-driven work tool, the chest buckle comprising first and second parts, wherein the first and second parts each comprises at least two attachment openings for attaching straps of the harness thereto, wherein the first part comprises a recess defining a cavity arranged to accommodate the second part therein, wherein the second part comprises a resilient locking member arranged to protrude through a hole in the first part when the second part is accommodated in the cavity to lock the first and second parts together, wherein the resilient locking member comprises a C-shaped web portion attached at one end to the second part, and a transversal portion arranged at the opposite end of the web portion and substantially parallel to a longitudinal edge of the second part, wherein the web portion is adapted to act as a spring to bias the transversal portion in a direction substantially perpendicular to the longitudinal edge to protrude beyond the longitudinal edge.

2. The chest buckle according to claim 1, wherein the cavity comprises an opening arranged in a side portion of the first part, opposite the attachment openings for the straps of the harness and adapted to receive the second part in a lateral translational or linear insertion movement.

3. The chest buckle according to claim 1, wherein the hole is arranged in a longitudinal edge of the first part, which extends parallel to an insertion direction, and the resilient locking member is arranged to protrude through the hole in a direction substantially perpendicular to the insertion direction.

4. The chest buckle according to claim 1, wherein the web portion comprises two parallel shanks.

5. The chest buckle according to claim 1, wherein the transversal portion comprises a bevelled or chamfered surface on a leading and/or trailing edge seen in an insertion direction of the second part with respect to the first part.

6. The chest buckle according to claim 1, wherein the first part and the second part have a substantially hexagonal shape.

7. The chest buckle according to claim 6, wherein the first part comprises two substantially hexagonal plates joined together along four edges.

8. The chest buckle according to claim 6, wherein the at least two attachment openings for the straps of the harness comprise slots arranged on two adjacent edges of the first and second parts, respectively.

9. The chest buckle according to claim 8, wherein the edges comprising the slots on the first and second parts are arranged diametrically opposite of each other when the first and second parts are assembled together in a locked position.

10. A harness comprising the chest buckle according to claim 1.

11. The chest buckle according to claim 1, wherein the second part comprises a notch arranged on a distal end seen in an insertion direction of the second part with respect to the first part, wherein the first part comprises a corresponding protrusion arranged in the recess and adapted to fit into the notch when the first and second parts are assembled together in a locked position.

12. A chest buckle for a harness for carrying a handheld motor-driven work tool, the chest buckle comprising first and second parts, wherein the first and second parts each comprises at least two attachment openings for attaching straps of the harness thereto, wherein the first part comprises a recess defining a cavity arranged to accommodate the second part therein, wherein the second part comprises a resilient locking member arranged to protrude through a hole in the first part when the second part is accommodated in the cavity to lock the first and second parts together, wherein the second part comprises a notch arranged on a distal end seen in an insertion direction of the second part with respect to the first part, wherein the first part comprises a corresponding protrusion arranged in the recess and adapted to fit into the notch when the first and second parts are assembled together in a locked position.

13. The chest buckle according to claim 12, wherein the cavity comprises an opening arranged in a side portion of the first part, opposite the attachment openings for the straps of the harness and adapted to receive the second part in a lateral translational or linear insertion movement.

14. The chest buckle according to claim 12, wherein the hole is arranged in a longitudinal edge of the first part, which extends parallel to the insertion direction, and the resilient locking member is arranged to protrude through the hole in a direction substantially perpendicular to the insertion direction.

15. The chest buckle according to claim 12, wherein the resilient locking member comprises a C-shaped web portion attached at one end to the second part, and a transversal portion arranged at the opposite end of the web portion and substantially parallel to a longitudinal edge of the second part, wherein the web portion is adapted to act as a spring to bias the transversal portion in a direction substantially perpendicular to the longitudinal edge to protrude beyond the longitudinal edge.

16. The chest buckle according to claim 15, wherein the web portion comprises two parallel shanks.

17. The chest buckle according to claim 15, wherein the transversal portion comprises a bevelled or chamfered surface on a leading and/or trailing edge seen in the insertion direction of the second part with respect to the first part.

18. The chest buckle according to claim 12, wherein the first part and the second part have a substantially hexagonal shape and the first part comprises two substantially hexagonal plates joined together along four edges.

19. The chest buckle according to claim 18, wherein the at least two attachment openings for the straps of the harness comprise slots arranged on two adjacent edges of the first and second parts, respectively.

20. The chest buckle according to claim 19, wherein the edges comprising the slots on the first and second parts are arranged diametrically opposite of each other when the first and second parts are assembled together in a locked position.

21. A harness comprising the chest buckle according to claim 12.

* * * * *